US011519681B2

(12) United States Patent
Kennedy

(10) Patent No.: US 11,519,681 B2
(45) Date of Patent: Dec. 6, 2022

(54) SYSTEM FOR A DELAYED-OPPOSED-PISTON GAS ACTION ASSEMBLY

(71) Applicant: Jordan Kristomas Kennedy, Chandler, AZ (US)

(72) Inventor: Jordan Kristomas Kennedy, Chandler, AZ (US)

( * ) Notice: Subject to any disclaimer, the term of this patent is extended or adjusted under 35 U.S.C. 154(b) by 0 days.

(21) Appl. No.: 17/233,475

(22) Filed: Apr. 17, 2021

(65) Prior Publication Data

US 2022/0333884 A1 Oct. 20, 2022

(51) Int. Cl.
*F41A 5/26* (2006.01)

(52) U.S. Cl.
CPC ..... *F41A 5/26* (2013.01)

(58) Field of Classification Search
CPC ..... F41A 5/26; F41A 5/28; F41A 5/18; F41A 5/22
USPC ..... 89/191.01, 191.02, 192, 193
See application file for complete search history.

(56) References Cited

U.S. PATENT DOCUMENTS 2,494,889 A * 1/1950 Maillard ..... F41A 5/22 89/193
2,865,256 A 12/1958 Marsh
3,707,110 A * 12/1972 Alday ..... F41A 5/28 89/193
3,999,461 A * 12/1976 Johnson ..... F41A 9/30 89/185
4,102,242 A * 7/1978 Liedke ..... F41A 5/22 89/191.01
5,900,577 A 5/1999 Robinson et al.
5,959,234 A * 9/1999 Scaramucci ..... F41A 5/22 89/193
6,901,689 B1 6/2005 Bergstrom
7,596,900 B2 10/2009 Robinson et al.
8,065,949 B1 * 11/2011 Molinari ..... F41A 5/28 89/193
8,596,185 B1 12/2013 Soong et al.
8,806,789 B2 8/2014 Devine
8,813,632 B2 8/2014 Adams
(Continued)

FOREIGN PATENT DOCUMENTS

DE 19903610 A1 * 8/2000 ..... F41A 5/22
WO WO-2008108786 A2 * 9/2008 ..... F41A 5/22
(Continued)

OTHER PUBLICATIONS

Heckler & Koch Defense XM8 Lightweight Modular Weapon System Pamphlet Current Website is https://hk-usa.com/.

*Primary Examiner* — Jonathan C Weber
(74) *Attorney, Agent, or Firm* — Lisa Foundation Patent Law Clinic at Arizona State University

(57) ABSTRACT

System for a delayed-opposed-piston gas action assembly. Specifically, the system is comprised of a bolt, a bolt carrier, a gas block, a bolt piston, and a vent piston. Each piston will have a corresponding piston cup that will act on the piston from the gas discharged from the round. Each piston will also have a corresponding spring to bring the piston back to its original position after the gas has dissipated from the system. During the process of the firearm being discharged, the two pistons will act on the bolt carrier, causing the casing of the round to be ejected from the firearm, and a new round to be loaded into the firearm, so that the firearm can be discharged again.

20 Claims, 4 Drawing Sheets

(56) References Cited

U.S. PATENT DOCUMENTS

| | | | | |
|---|---|---|---|---|
| 9,097,475 | B2 * | 8/2015 | Ricks | F41A 5/22 |
| 9,212,856 | B2 * | 12/2015 | Baker | F41A 5/28 |
| 9,291,415 | B1 | 3/2016 | Beaty | |
| 9,383,149 | B2 * | 7/2016 | Ricks | F41A 5/22 |
| 9,816,768 | B2 * | 11/2017 | Ricks | F41A 3/66 |
| 9,879,931 | B2 | 1/2018 | Patel | |
| 10,048,029 | B2 | 8/2018 | Larson, Jr. | |
| 10,345,062 | B2 * | 7/2019 | Alexander | F41A 5/28 |
| 10,386,145 | B2 | 8/2019 | Golan | |
| 10,458,732 | B2 | 10/2019 | Neitzling | |
| 2009/0031605 | A1 | 2/2009 | Robinson | |
| 2011/0271826 | A1 * | 11/2011 | Molinari | F41A 5/22 89/193 |
| 2012/0137870 | A1 * | 6/2012 | Lindsay | F41A 1/10 42/1.06 |
| 2013/0025445 | A1 * | 1/2013 | Windauer | F41A 5/28 89/193 |
| 2014/0150638 | A1 * | 6/2014 | Ricks | F41A 5/26 89/193 |
| 2015/0226502 | A1 | 8/2015 | Beaty | |
| 2015/0241149 | A1 | 8/2015 | McMillen et al. | |
| 2015/0260470 | A1 * | 9/2015 | Foster | F41A 5/18 89/193 |
| 2016/0084597 | A1 * | 3/2016 | Ricks | F41A 5/28 89/193 |
| 2016/0202006 | A1 * | 7/2016 | Daley, Jr. | F41A 5/26 89/193 |
| 2018/0172376 | A1 * | 6/2018 | Alexander | F41A 9/72 |
| 2019/0339031 | A1 * | 11/2019 | Alexander | F41A 5/26 |

FOREIGN PATENT DOCUMENTS

| | | | | |
|---|---|---|---|---|
| WO | WO-2009097551 | A1 * | 8/2009 | F41A 1/10 |
| WO | WO-2010123604 | A2 * | 10/2010 | F41A 21/28 |

* cited by examiner

SYSTEM FOR A DELAYED-OPPOSED-PISTON GAS ACTION ASSEMBLY

CROSS REFERENCE TO RELATED APPLICATIONS

Not applicable.

STATEMENT REGARDING FEDERALLY SPONSORED RESEARCH

Not applicable.

NAMES OF PARTIES TO A JOINT RESEARCH AGREEMENT

Not applicable.

REFERENCE TO A SEQUENCE LISTING, TABLE, OR COMPUTER PROGRAM

Not applicable.

BACKGROUND

Different types of firearms can use a plurality of systems to eject the casing of a round and load it with a new round, ready for the user to fire the next round. One such system is the gas-operated reloading. The three most common types of these systems are direct impingement, short stroke piston, and long stroke piston. These systems need to be finely tuned to each specific round that is being used, even of the same bullet diameter. If there is too little gas, then the casing will not be ejected properly, and the firearm could jam. This would interrupt the user from firing another round without first ejecting and/or unjamming the firearm. If there is too much gas, then the walls of the casing could get pressed against the chamber and the friction could cause the casing to get stuck inside without ejecting. Current systems allow the user to adjust the gas that is led back to the bolt carrier, typically by adjusting the gas block volume using a screw. Such systems need to be tuned manually. This process can potentially be time consuming and may not be easy to do when the firearm needs to be used.

So as to reduce the complexity and length of the Detailed Specification, and to fully establish the state of the art in certain areas of technology, Applicant(s) herein expressly incorporate(s) by reference all of the following materials identified in each numbered paragraph below.

U.S. Pat. No. 9,879,931 discloses a multi-caliber machine gun system. The machine gun has different types of ammunition feed trays. When a certain type of ammunition feed tray is attached to the receiver assembly, the receiver assembly can be configured to fire that type of ammunition.

U.S. Pat. No. 10,386,145 discloses a double barrel firearm where each of the barrels can be adjusted. The angular orientation (e.g., azimuth and elevation) of each barrel can be adjusted utilizing two adjustment members mounted on to the barrels.

U.S. Pat. No. 10,458,732 discloses a bolt carrier extension system. The bolt carrier extension system allows the firearm to incorporate elongated upper and lower receivers, such that long-action or other center fire cartridges can be chambered within AR rifles.

U.S. Pat. No. 9,291,415 discloses an adjustable gas key. The gas key contains an inlet and outlet tube, as well as an inner volume. The user can adjust the inner volume with an adjustment device so that the amount of gas being vented, and the amount of gas sent back to the bolt carrier, is changed.

U.S. Pat. No. 8,596,185 discloses an adjustable gas block method and system for a gas operation firearm. The adjustable gas block system adjusts the size of the gas port, and thus the amount of gas, that enters into the gas tube. This is accomplished with a sliding adjustment plate, where the desired gas port is slid into place depending on the amount of gas desired.

U.S. Pat. No. 8,813,632 discloses an adjustable firearm gas block. This gas block contains a threaded bore with a set screw that enters into, and can restrict, the gas channel. As the set screw constricts the gas channel depending on how far the user screws the set screw in. There is also a second bore adjacent to the first threaded bore, which houses a detent plunger, which can lock the set screw into its desired, gas channel restricting, position.

U.S. Pat. No. 7,596,900 discloses a multi-caliber, ambidextrously controllable, firearm. There is an adjustable ejection system, which has a deflector and an ejection port. The deflector can be attached to one of at least two attachment positions, to adjust the size of the ejection port.

U.S. Pat. No. 2,865,256 discloses a compensating device for firearms. The compensating device takes the form of a system analogous to a double acting fluid motor to regulate the gas needed to cycle the firearm. This invention utilizes a single piston.

U.S. Pat. No. 6,901,689 discloses a pneumatic counter-recoil modulator. This is a gas cartridge system that is inserted into the firearm in order to help reduce recoil when the firearm is discharged. The cartridge is pre-loaded with gas from the manufacturer.

U.S. Pat. No. 10,048,029 discloses a firearm with a gas piston system. The system utilizes a gas regulator with a gas purge plug. Excess gas from the firearm's discharge is purged from the system once it reaches a certain threshold.

U.S. Pat. No. 5,900,577 discloses a modular, multi-caliber weapon system. The system can be reconfigured to fire a wide range of different calibers. The reconfiguration is accomplished by changing the following components: barrel, operating rod, recoil spring, and buffer; gas tube, bolt head, firing pin and extractor; and magazine well.

U.S. Pat. No. 8,806,789 discloses a multi-caliber interchangeable rifle bolt system. This firearm can be reconfigured to fire different calibers, by changing out the stock of the weapon. All of the elements necessary to reconfigure the weapon are stored in the stock of the weapon.

U.S. Pat. Pub. No. US 2015/0241149 discloses an adjustable gas key for an autoloading firearm. The gas key is coupled to a moving parts assembly, where it directs gas towards that assembly such that the firearm is cycled. The gas key has an adjustment control, which may be in some form of screw, which can affect the amount of gas directed. There can also be embodiments that allow a certain amount of gas to vent.

U.S. Pat Pub. No. US 2009/0031605 discloses a multi-caliber, ambidextrously controllable, firearm. This is a continuation to U.S. Pat. No. 7,596,900. There is an adjustable ejection system, which has a deflector and an ejection port. The deflector can be attached to one of at least two attachment positions, to adjust the size of the ejection port.

U.S. Pat. Pub. No. US 2015/0226502 discloses a bolt carrier with integral adjustable gas key. This is a continuation-in-part of U.S. Pat. No. 9,291,415. There is a bolt carrier with an integral adjustable gas key. The adjustable gas key includes a tube portion coupled to a base portion. An inlet passage extends through the tube portion and an outlet passage through the base portion. There is also an adjustment device, which adjusts the inner volume of the gas key. The adjustment of the inner volume adjusts the force of action of the bolt carrier.

Applicant(s) believe(s) that the material incorporated above is "non-essential" in accordance with 37 CFR 1.57, because it is referred to for purposes of indicating the background of the invention or illustrating the state of the art. However, if the Examiner believes that any of the above-incorporated material constitutes "essential material" within the meaning of 37 CFR 1.57(c)(1)-(3), Applicant(s) will amend the specification to expressly recite the essential material that is incorporated by reference as allowed by the applicable rules.

SUMMARY

The present invention provides among other things a delayed-opposed-piston gas action system.

A delayed-opposed-piston gas action assembly is comprised of a bolt that interfaces with a round in a chamber of a firearm; a bolt carrier that interfaces with the bolt; a gas block that interfaces with a gas port on a barrel; a bolt piston that interfaces with the bolt carrier and the gas block; and a vent piston that interfaces with the bolt carrier and the gas block. The bolt piston will also have a bolt piston cup and a bolt piston spring. The vent piston will also have a vent piston cup and a vent piston spring. After this point, a portion of the expelled gas will be vented. Then, the vent piston spring will act on the vent piston. Then, the vent piston acts on the bolt carrier, causing a casing of the round to be ejected from the firearm. Then, the bolt piston spring will act on the bolt piston. The bolt piston will then act on the bolt carrier. The bolt carrier will then load a new round into the firearm.

When the firearm is discharged, the gas block will direct an expelled gas to the bolt piston cup and the vent piston cup. When this happens, the bolt piston will act on the bolt piston spring, and the vent piston will act on the vent piston spring.

Aspects and applications of the invention presented here are described below in the drawings and detailed description of the invention. Unless specifically noted, it is intended that the words and phrases in the specification and the claims be given their plain, ordinary, and accustomed meaning to those of ordinary skill in the applicable arts. The inventor is fully aware that he can be his own lexicographer if desired. The inventor expressly elects, as his own lexicographers, to use only the plain and ordinary meaning of terms in the specification and claims unless he clearly states otherwise and then further, expressly sets forth the "special" definition of that term and explains how it differs from the plain and ordinary meaning. Absent such clear statements of intent to apply a "special" definition, it is the inventor's intent and desire that the simple, plain and ordinary meaning to the terms be applied to the interpretation of the specification and claims.

For the purposes of this invention, the term caliber references the specific geometry of a round.

The inventor is also aware of the normal precepts of English grammar. Thus, if a noun, term, or phrase is intended to be further characterized, specified, or narrowed in some way, then such noun, term, or phrase will expressly include additional adjectives, descriptive terms, or other modifiers in accordance with the normal precepts of English grammar. Absent the use of such adjectives, descriptive terms, or modifiers, it is the intent that such nouns, terms, or phrases be given their plain, and ordinary English meaning to those skilled in the applicable arts as set forth above.

Further, the inventor is fully informed of the standards and application of the special provisions of 35 U.S.C. § 112(f). Thus, the use of the words "function," "means" or "step" in the Detailed Description or Description of the Drawings or claims is not intended to somehow indicate a desire to invoke the special provisions of 35 U.S.C. § 112(f), to define the invention. To the contrary, if the provisions of 35 U.S.C. § 112(f) are sought to be invoked to define the inventions, the claims will specifically and expressly state the exact phrases "means for" or "step for, and will also recite the word "function" (i.e., will state "means for performing the function of [insert function]"), without also reciting in such phrases any structure, material or act in support of the function. Thus, even when the claims recite a "means for performing the function of . . . " or "step for performing the function of . . . ," if the claims also recite any structure, material or acts in support of that means or step, or that perform the recited function, then it is the clear intention of the inventor not to invoke the provisions of 35 U.S.C. § 112(f). Moreover, even if the provisions of 35 U.S.C. § 112(f) are invoked to define the claimed inventions, it is intended that the inventions not be limited only to the specific structure, material or acts that are described in the preferred embodiments, but in addition, include any and all structures, materials or acts that perform the claimed function as described in alternative embodiments or forms of the invention, or that are well known present or later-developed, equivalent structures, material or acts for performing the claimed function.

The foregoing and other aspects, features, and advantages will be apparent to those artisans of ordinary skill in the art from the DETAILED DESCRIPTION and DRAWINGS, and from the CLAIMS.

BRIEF DESCRIPTION OF THE SEVERAL VIEWS OF THE DRAWINGS

A more complete understanding of the present invention may be derived by referring to the detailed description when considered in connection with the following illustrative figures. In the figures, like reference numbers refer to like elements or acts throughout the figures.

DETAILED DESCRIPTION

In the following description, and for the purposes of explanation, numerous specific details are set forth in order to provide a thorough understanding of the various aspects of the invention. It will be understood, however, by those skilled in the relevant arts, that the present invention may be practiced without these specific details. In other instances, known structures and devices are shown or discussed more generally in order to avoid obscuring the invention. In many cases, a description of the operation is sufficient to enable one to implement the various forms of the invention, particularly when the operation is to be implemented in software. It should be noted that there are many different and alternative configurations, devices and technologies to which the disclosed inventions may be applied. The full scope of the inventions is not limited to the examples that are described below.

Figure 1A:
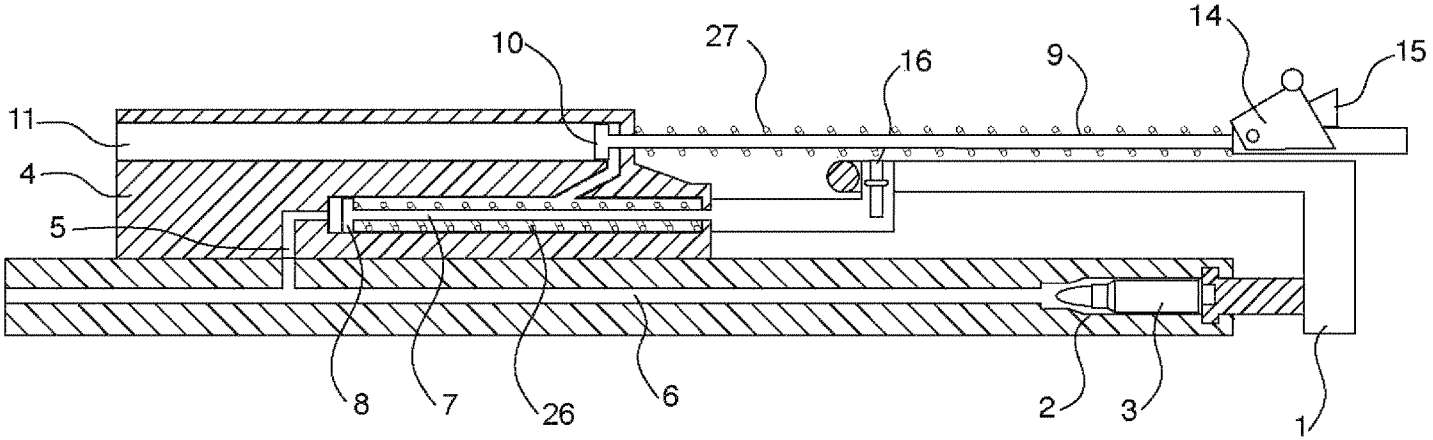
FIG. 1*a* depicts the delayed-opposed-piston gas action assembly with serial pistons before the round is discharged; and both pistons are relaxed.
Figure 1B:
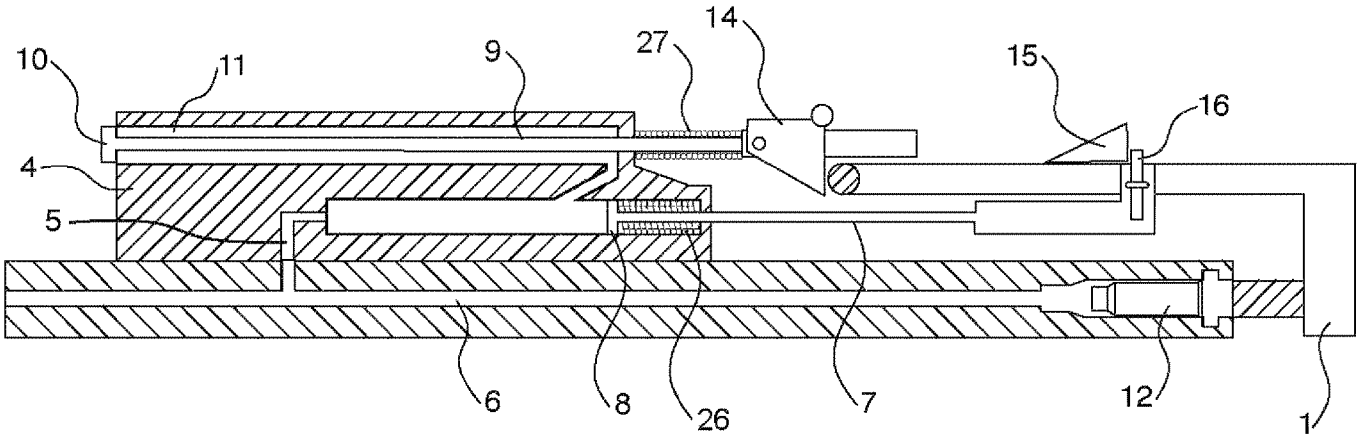
FIG. 1B depicts the delayed-opposed-piston gas action assembly with serial pistons after the round is discharged; and both pistons are compressed.
Figure 1C:
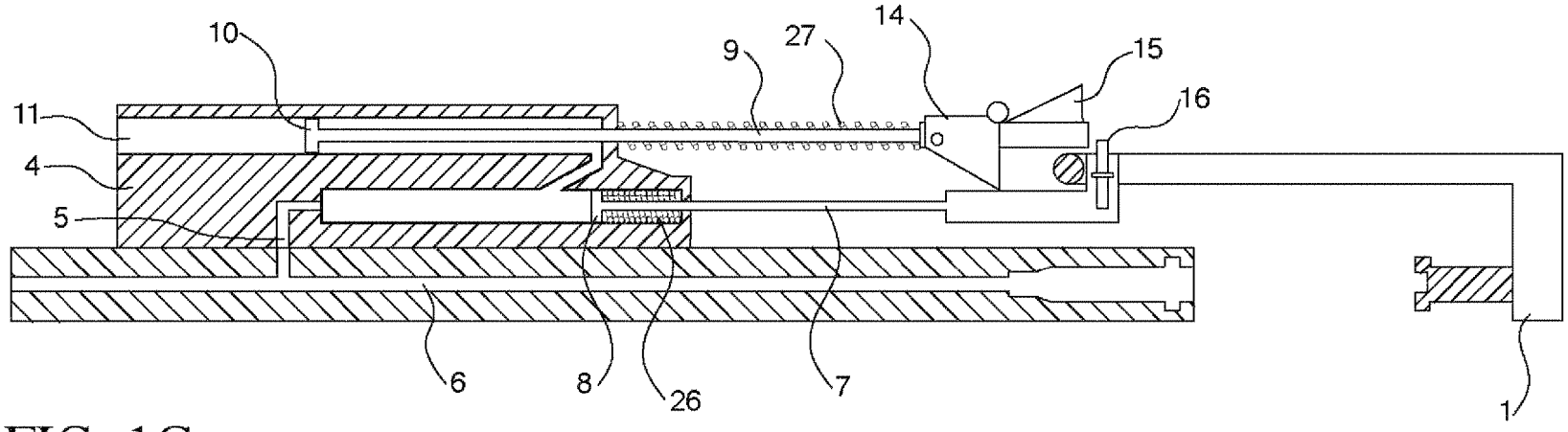
FIG. 1*c* depicts the delayed-opposed-piston gas action assembly with serial pistons after the round is discharged; and the bolt piston is compressed, and the vent piston is partially compressed.
Figure 1D:
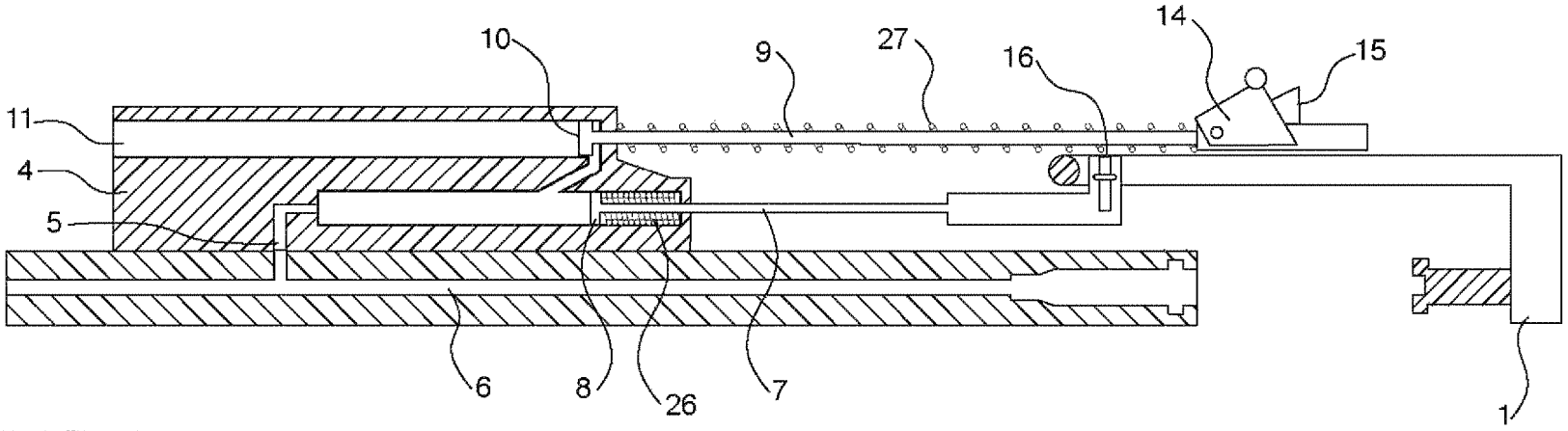
FIG. 1*d* depicts the delayed-opposed-piston gas action assembly with serial pistons after the round is discharged; and the bolt piston is compressed, and the vent piston is relaxed.
Figure 1E:
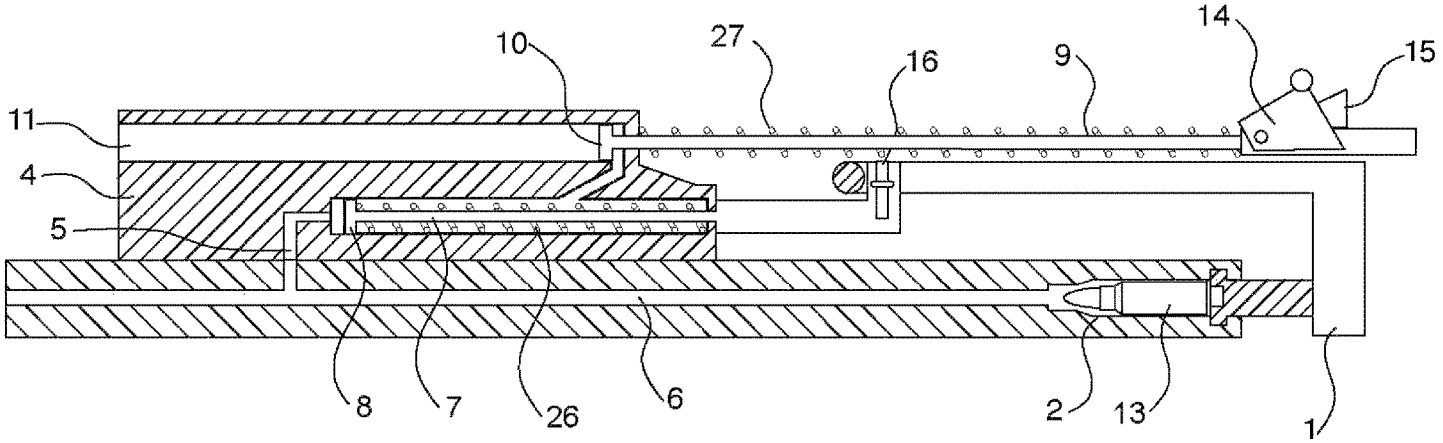
FIG. 1*e* depicts the delayed-opposed-piston gas action assembly with serial pistons after the round is discharged and a new round is loaded; and both pistons are relaxed.

In FIG. 1A through FIG. 1E, a non-limiting embodiment of the delayed-opposed-piston gas action assembly is shown. The embodiment shows two serial pistons: the bolt piston 7 and the vent piston 9. FIG. 1A shows the state of the assembly before the firearm is discharged. The bolt carrier 1 has already loaded the round 3 in the chamber 2. Once the firearm is discharged, as shown in FIG. 1B, the gas will move from the barrel 6 through the gas port 5 inside the gas block 4 and act on the bolt piston 7 via the bolt piston cup 8, and the vent piston 9 via the vent piston cup 10. When the bolt piston 7 is acted on, the bolt piston spring 26 is compressed. When the vent piston 9 is acted on, the vent piston spring 27 is compressed. Once pushed back, the bolt piston 7 will lock into place via the lock 16. Once all of the gas has been vented through gas vent 11, the vent piston spring 27 will act on the vent piston 9, moving the vent piston 9 towards the bolt carrier 1. The vent piston 9 will couple via latch 14 to the bolt carrier 1 and act on the bolt carrier 1, causing the casing 12 of the discharged round to be ejected from the firearm. This is shown in FIG. 1C. The latch actuator 15 will act on the latch 14 to uncouple the vent piston 9 from the bolt carrier 1. The vent piston 9 will then act on lock 16 to unlock the bolt piston 7 as shown in FIG. 1D. At this point the vent piston 9 is back in the starting position. Once unlocked, the bolt piston 7 is then acted on by the bolt piston spring 26, which moves the bolt piston 7 back into the starting position. When the bolt piston 7 is acted on by the bolt piston spring 26, this acts on the bolt carrier 1 bringing it back to the bolt carrier's 1 starting position, as well as loading a new round 13 into the firearm. Once everything is complete, the firearm is ready to be discharged again, as shown in FIG. 1E. The non-limiting embodiment shown in FIG. 1A through FIG. 1E would be the optimal embodiment for the delayed-opposed-piston gas action assembly.

Figure 2:
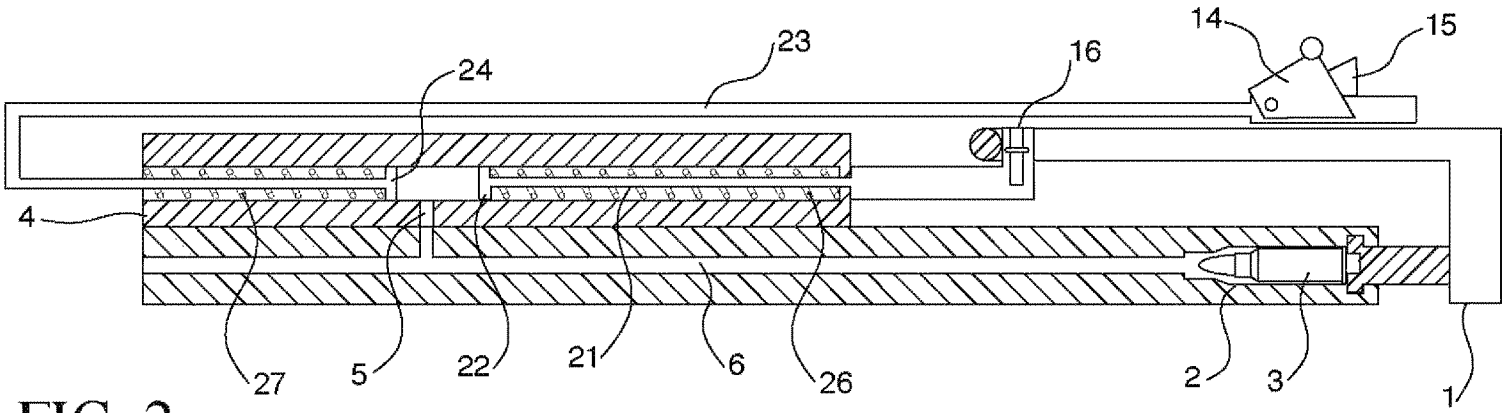
FIG. 2 depicts the delayed-opposed-piston gas action assembly with opposed long stroke pistons before the round is discharged; and both pistons are relaxed.

In FIG. 2, a non-limiting embodiment of the delayed-opposed-piston gas action assembly is shown. This embodiment shows two opposed pistons: the long stroke bolt piston 21 and the long stroke vent piston 23. In this embodiment, both pistons will be acted on by the discharged gas at the same time, instead of in serial as in FIG. 1A through FIG. 1E. In this embodiment, there is the long stroke bolt piston cup 22 and the long stroke vent piston cup 24. FIG. 2 shows the state of the assembly before the firearm is discharged. The bolt carrier 1 has already loaded the round 3 in the chamber 2. Once the firearm is discharged, the gas will move from the barrel 6 through the gas port 5 inside the gas block 4 and act on the long stroke bolt piston cup 22 and the long stroke vent piston cup 24. Both piston cups are acted on at the same time. The long stroke bolt piston cup 22 will then act on the long stroke bolt piston 21, at the same time the long stroke vent piston cup 24 will act on the long stroke vent piston 23. When the long stroke bolt piston 21 is acted on, the bolt piston spring 26 is compressed. When the long stroke vent piston 23 is acted on, the vent piston spring 27 is compressed. Once pushed back, the long stroke bolt piston 21 will lock into place via the lock 16. At the same time, the vent piston spring 27 will act on the long stroke vent piston 23, moving the long stroke vent piston 23 towards the bolt carrier 1. The long stroke vent piston 23 will couple via latch 14 to the bolt carrier 1 and act on the bolt carrier 1, causing the casing of the discharged round to be ejected from the firearm. The latch actuator 15 will act on the latch 14 to uncouple the long stroke vent piston 23 from the bolt carrier 1. The long stroke vent piston 23 will then act on lock 16 to unlock the long stroke bolt piston 21. At this point the long stroke vent piston 23 is back in the starting position. Once unlocked, the long stroke bolt piston 21 is then acted on by the bolt piston spring 26, which moves the long stroke bolt piston 21 back into the starting position. When the long stroke bolt piston 21 is acted on by the bolt piston spring 26, this acts on the bolt carrier 1 bringing it back to the bolt carrier's 1 starting position, as well as loading a new round into the firearm. Once everything is complete, the firearm is ready to be discharged again.

Figure 3:
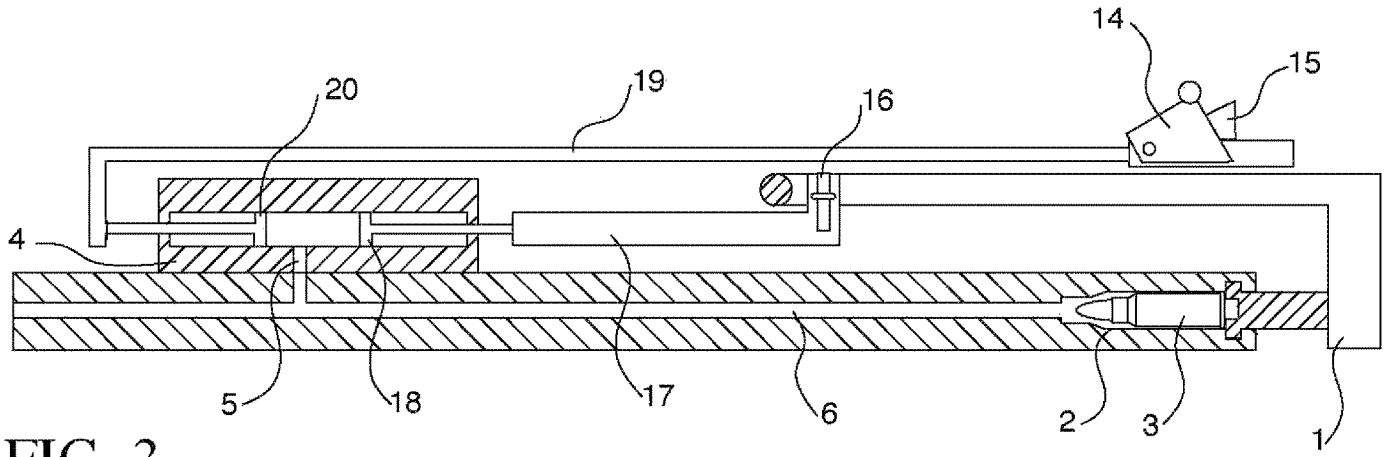
FIG. 3 depicts the delayed-opposed-piston gas action assembly with opposed short stroke pistons before the round is discharged; and both pistons are relaxed.

In FIG. 3, a non-limiting embodiment of the delayed-opposed-piston gas action assembly is shown. This embodiment shows two opposed pistons: the short stroke bolt piston 17 and the short stroke vent piston 19. In this embodiment, both pistons will be acted on by the discharged gas at the same time, instead of in serial as in FIG. 1A through FIG. 1E. In addition, these pistons are short stroke. This means that the piston cups are separate pieces than the pistons themselves. When the firearm is discharged, the pistons cups will throw the pistons into the correct position, rather than act on them as one solid piece. As such, in this embodiment, there is the short stroke bolt piston cup 18 and the short stroke vent piston cup 20. FIG. 3 shows the state of the assembly before the firearm is discharged. The bolt carrier 1 has already loaded the round 3 in the chamber 2. Once the firearm is discharged, the gas will move from the barrel 6 through the gas port 5 inside the gas block 4 and act on the short stroke bolt piston cup 18 and the short stroke vent piston cup 20. Both piston cups are acted on at the same time. The short stroke bolt piston cup 18 will then throw the short stroke bolt piston 17, at the same time the short stroke vent piston cup 20 will throw the short stroke vent piston 19. Once thrown back, the short stroke bolt piston 17 will lock into place via the lock 16. At the same time, the vent piston spring (not shown in this figure) will act on the short stroke vent piston 19, moving the short stroke vent piston 19 towards the bolt carrier 1. The short stroke vent piston 19 will couple via latch 14 to the bolt carrier 1 and act on the bolt carrier 1, causing the casing of the discharged round to be ejected from the firearm. The latch actuator 15 will act on the latch 14 to uncouple the short stroke vent piston 19 from the bolt carrier 1. The short stroke vent piston 19 will then act on lock 16 to unlock the short stroke bolt piston 17. At this point the short stroke vent piston 19 is back in the starting position. Once unlocked, the short stroke bolt piston 17 is then acted on by the bolt piston spring (not shown in this figure), which moves the short stroke bolt piston 17 back into the starting position. When the short stroke bolt piston 17 is acted on by the bolt piston spring (not shown in this figure), this acts on the bolt carrier 1 bringing it back to the bolt carrier's 1 starting position, as well as loading a new round into the firearm. Once everything is complete, the firearm is ready to be discharged again.

Figure 4:
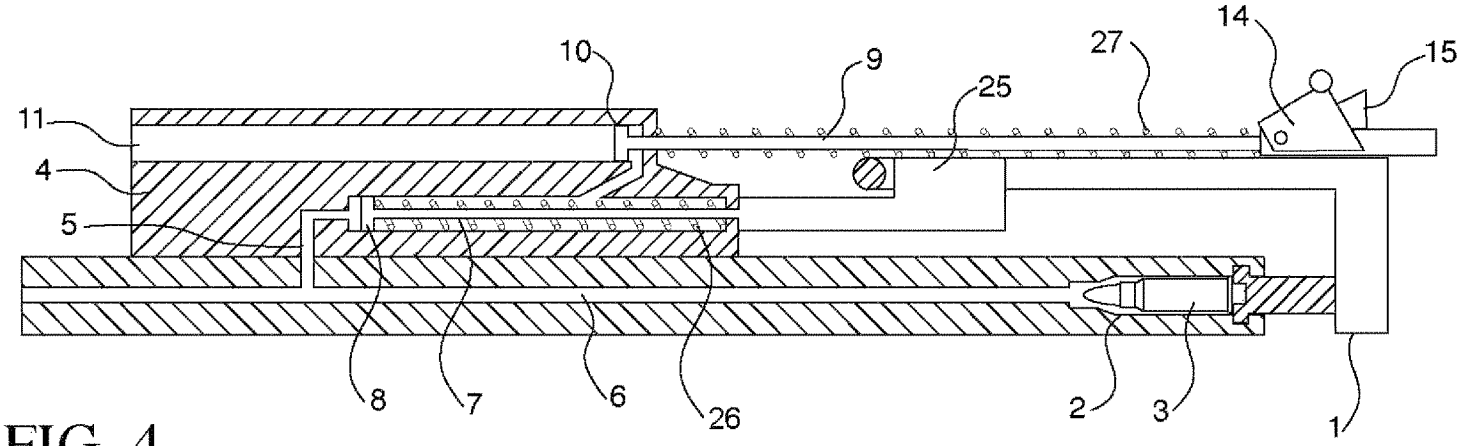
FIG. 4 depicts the delayed-opposed-piston gas action assembly with serial pistons, with a weighted bolt piston, before the round is discharged; and both pistons are relaxed.

In FIG. 4, a non-limiting embodiment of the delayed-opposed-piston gas action assembly is shown. This embodiment shows two serial pistons: the bolt piston 7 and the vent piston 9. In this embodiment, the bolt piston 7 will not lock in place after a discharge but will have more mass in the form of a weighted bolt piston head 25, such that the bolt piston 7 is starting to return after the vent piston 9 has finished its cycle and decoupled from the bolt carrier 1. FIG. 4 shows the state of the assembly before the firearm is discharged. The bolt carrier 1 has already loaded the round 3 in the chamber 2. Once the firearm is discharged, the gas will move from the barrel 6 through the gas port 5 inside the gas block 4 and act on the bolt piston 7 via the bolt piston cup 8 and the vent piston 9 via the vent piston cup 10. When the bolt piston 7 is acted on, the bolt piston spring 26 is compressed. When the vent piston 9 is acted on, the vent piston spring 27 is compressed. Once all of the gas has been vented through gas vent 11, the vent piston spring 27 will act on the vent piston 9, moving the vent piston 9 towards the bolt carrier 1. The vent piston 9 will couple via latch 14 to the bolt carrier 1 and act on the bolt carrier 1, causing the casing of the discharged round to be ejected from the firearm. The latch actuator 15 will act on the latch 14 to uncouple the vent piston 9 from the bolt carrier 1. At this point the vent piston 9 is back in the starting position. By this time, the bolt piston's 7 direction of travel has been reversed by the bolt piston spring 26. When the bolt piston 7 returns to the bolt piston's 7 starting position, the bolt piston 7 acts on the bolt carrier 1 bringing the bolt carrier 1 back to the bolt carrier's 1 starting position. When the bolt carrier 1 is brought back to its starting position, a new round is loaded into the firearm. Once everything is complete, the firearm is ready to be discharged again. This embodiment will not fare as well as the embodiment shown in FIG. 1A through FIG. 1E as variations in gas output between rounds can cause the timing between the pistons to be off, causing the firearm to jam.

The non-limiting embodiments shown through FIG. 1A through FIG. 4 can also be permutated with each other. For example, the short stroke pistons found in FIG. 3 could be utilized in FIG. 1A through FIG. 1E, FIG. 2, or FIG. 4. Furthermore, the weighted piston found in FIG. 4 could be utilized in FIG. 1A through FIG. 1E, FIG. 2, or FIG. 3. Additionally, the opposed piston configuration found in FIG. 2 and FIG. 3 could be utilized in FIG. 1A through FIG. 1E or FIG. 4. Finally, a single short stroke piston found in FIG. 3 could replace just one of either of the pistons in FIG. 1A through FIG. 1E, FIG. 2, or FIG. 4.

I claim:

1. A delayed-opposed-piston gas action assembly comprising:

a bolt configured to interface with a round in a chamber of a firearm;

a bolt carrier configured to interface with the bolt;

a gas block configured to interface with a gas port on a barrel, wherein the gas block is further configured to direct an expelled gas, wherein the expelled gas depends on when a discharge of the firearm occurs;

a bolt piston configured to interface with the bolt carrier and the gas block;

a vent piston configured to interface with the bolt carrier and the gas block, wherein the vent piston is further configured to travel in a direction opposite to a direction of travel of the bolt piston in response to being acted upon by the expelled gas; and a latch coupled to the vent piston, wherein the latch is configured to detachably couple the vent piston to the bolt carrier.

2. The delayed-opposed-piston gas action assembly of claim 1, wherein the bolt piston further comprises a bolt piston spring.

3. The delayed-opposed-piston gas action assembly of claim 1, wherein the vent piston further comprises a vent piston spring.

4. The delayed-opposed-piston gas action assembly of claim 1, wherein the gas block is further configured to direct the expelled gas to the bolt piston.

5. The delayed-opposed-piston gas action assembly of claim 1, wherein the bolt piston is further configured to act on the bolt piston spring, and the bolt piston spring is further configured to act on the bolt piston.

6. The delayed-opposed-piston gas action assembly of claim 1, wherein the gas block is further configured to direct the expelled gas to the vent piston.

7. The delayed-opposed-piston gas action assembly of claim 1, wherein the vent piston is further configured to act on the vent piston spring, and the vent piston spring is further configured to act on the vent piston.

8. The delayed-opposed-piston gas action assembly of claim 1, wherein the vent piston acts on the bolt carrier and a casing of the round is ejected from the firearm.

9. The delayed-opposed-piston gas action assembly of claim 1, wherein the bolt piston is further configured to act on the bolt carrier.

10. The delayed-opposed-piston gas action assembly of claim 1, wherein the bolt carrier is further configured to load a new round into the chamber when acted on by the bolt piston.

11. A delayed-opposed-piston gas action assembly comprising:

a bolt configured to interface with a round in a chamber of a firearm;

a bolt carrier configured to interface with the bolt;

a gas block configured to interface with a gas port on a barrel, wherein the gas block is further configured to direct an expelled gas;

a vent piston configured to interface with the bolt carrier and the gas block; and a latch coupled to the vent piston, wherein the latch is configured to detachably couple the vent piston to the bolt carrier.

12. The delayed-opposed-piston gas action assembly of claim 11, wherein the vent piston is further configured to travel in a same direction as a discharged round in response to the vent piston being acted upon by the expelled gas.

13. The delayed-opposed-piston gas action assembly of claim 11, further comprising a latch actuator configured to uncouple the vent piston from the bolt carrier.

14. The delayed-opposed-piston gas action assembly of claim 11, further comprising a bolt piston configured to interface with the bolt carrier and the gas block, wherein the bolt piston is configured to travel in an opposite direction to a discharged round in response to the bolt piston being acted upon by the expelled gas.

15. The delayed-opposed-piston gas action assembly of claim 14, further comprising a bolt piston spring coupled to the bolt piston, wherein the bolt piston spring is configured to move the bolt piston back into a starting position.

16. The delayed-opposed-piston gas action assembly of claim 14, further comprising a lock configured to hold the bolt piston in a position distal from the gas port.

17. The delayed-opposed-piston gas action assembly of claim 14, wherein the bolt piston is further configured to act on the bolt carrier.

18. The delayed-opposed-piston gas action assembly of claim 17, wherein the bolt carrier is further configured to load a new round into the chamber when acted on by the bolt piston.

19. The delayed-opposed-piston gas action assembly of claim 11, further comprising a vent piston spring coupled to the vent piston, wherein the vent piston spring is configured to move the vent piston back into a starting position.

20. The delayed-opposed-piston gas action assembly of claim 11, wherein the vent piston acts on the bolt carrier and a casing of the round is ejected from the firearm.

* * * * *